US005409265A

United States Patent [19]

Douglass

[11] Patent Number: 5,409,265

[45] Date of Patent: Apr. 25, 1995

[54] SKATEBOARD WITH BALL ROLLERS

[76] Inventor: Sharon Douglass, 129 E. 4th St., New York, N.Y. 10003

[21] Appl. No.: 180,429

[22] Filed: Jan. 12, 1994

[51] Int. Cl.[6] ..... A63C 17/00

[52] U.S. Cl. ..... 280/843; 280/11.27; 280/87.041

[58] Field of Search ..... 280/11.27, 11.28, 843, 280/87.041, 87.042, 11.19

[56] References Cited

U.S. PATENT DOCUMENTS

| | | | |
|---|---|---|---|
| 597,025 | 1/1898 | Schwartz | 280/843 |
| 3,310,320 | 3/1967 | Hanna et al. | 280/87.042 |
| 3,522,951 | 8/1970 | Tyson | 280/843 |
| 3,895,597 | 7/1975 | Olevsky | 280/87.047 |
| 4,149,735 | 4/1979 | Blackburn et al. | 280/843 |
| 5,312,758 | 5/1994 | Giorgio | 280/87.041 |

FOREIGN PATENT DOCUMENTS

| | | | |
|---|---|---|---|
| 710 | of 1876 | United Kingdom | 280/843 |
| 9205845 | 4/1992 | WIPO | 280/843 |

*Primary Examiner*—Richard M. Camby

*Attorney, Agent, or Firm*—Steven H. Bazerman

[57] ABSTRACT

A skateboard has ball rollers rotatably mounted within cavities at the bottom of the body of the skateboard. A plurality of ball bearings mounted within the cavity contact the roller ball and rotate as the roller ball rotates. A plurality of round islands or mounts are located adjacent to each roller ball for receiving a side guide or a side plug which control the pitching and steering of the body of the skateboard. Each is detachably connected to the mount depending on the desired length. A glide plate is provided over the cavities at the bottom of the body for providing a sliding surface. Air passages are provided from the front end and the back end of the skateboard to each cavity for cooling the ball bearings located within. Circular cover plates fixed to the body over the glide plate and over both the mounts and the roller balls such that each roller ball partially extends through the cover plate and that the side guide and the side plug protrude therein. A conical cleaner is provided adjacent each roller ball for contacting the roller ball in order to clean debris from the roller ball.

18 Claims, 2 Drawing Sheets

SKATEBOARD WITH BALL ROLLERS

FIELD AND BACKGROUND OF THE INVENTION

The present invention relates in general to skateboards and in particular to a new and useful skateboard using a plurality of ball rollers.

U.S. Pat. Nos. 3,379,454 and 3,310,320 disclose a ball supported skateboard with one or more spherical balls for traveling over the ground or floor. U.S. Pat. No. 4,149,735 discloses the use of bearing rings to allow a greater degree of movement and rotation. These patents do not disclose a construction, including a glide plate and side guides for use in controlling the movement of the skateboard.

SUMMARY OF THE INVENTION

The present invention comprises a skateboard having a roller ball rotatably mounted at each end of the body of the skateboard. Each roller ball is rotatably mounted within a cavity formed at the underside of the body. Within each cavity, a plurality of ball bearings are rotatably mounted within holders. Each holder is mounted within the cavity such that the ball bearings contact the roller ball and rotate upon the rotation of the roller ball.

Round islands or mounts are provided adjacent each roller ball for receiving a detachably connected side guide. The side guides comprise a cylinder having a rotatably mounted ball bearing held tightly in place by a spacer and extend downwardly at a 90° angle from the underside of the body of the skateboard adjacent the roller ball when connected to the mount. The side guides vary in length and also in bottom cylinder aperture angle depending on the length chosen.

The mounts also receive a plug which is detachably connected to the mount and fits directly over the mount, protecting the interior. The side guide provides traction for steering. The lateral pitch of the body of the skateboard is unhampered by the plug while a side guide inhibits pitch by contacting the riding surface at the ball bearing.

A conical extension of each circular cover plate extends from the underside of the body at each cavity and partially houses the roller ball, thereby allowing the roller ball to extend through the conical extension for contacting and rotating about a surface. Conical cleaners are located within the conical extension and contact the roller ball for scraping debris from the roller ball.

The body of the skateboard has a front end and a back end which are upwardly inclined for control purposes. Front air passages and a back air passages lead from the front end and the back end respectively to each cavity containing the roller ball for cooling the ball bearings within the cavity.

A plurality of elongated islands are fixed between each cavity and horizontally extend between the cavities. A slick-sliding glide plate is fixed to the underside of the body for providing a slick-sliding surface. Circular cover plates having apertures are provided over each roller ball such that the roller ball extends through the cover plate. Apertures in the cover plate allow for the accommodation of the plugs or the side guides over the mounts or islands and the securing bolts over holes in the body.

The various features of novelty which characterize the invention are pointed out with particularity in the claims annexed to and forming a pan, of this disclosure.

For a better understanding of the invention, its operating advantages and specific objectives attained by its uses, reference is made to the accompanying drawings and descriptive matter in which preferred embodiments of the invention are illustrated.

DESCRIPTION OF THE PREFERRED EMBODIMENTS

Figure 1:
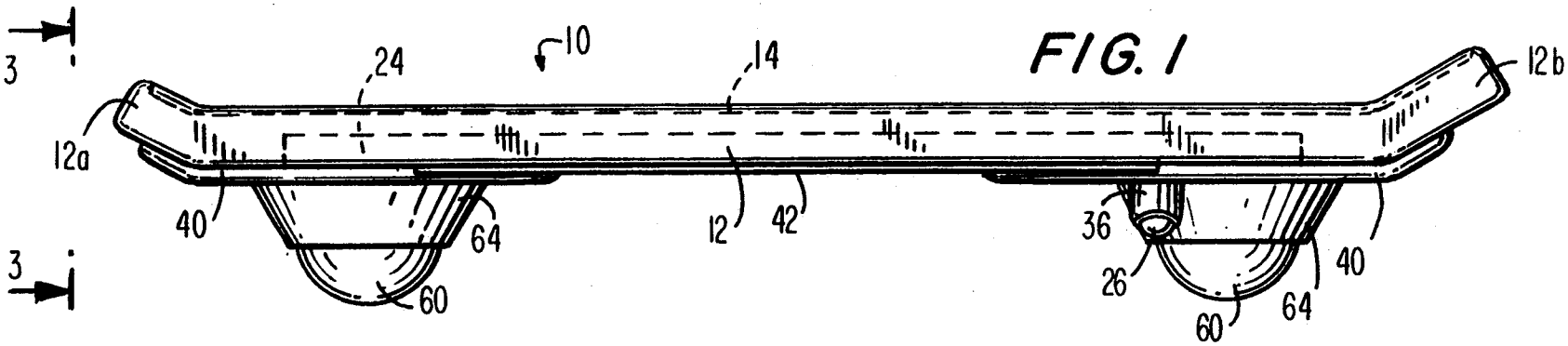
FIG. 1 is a side view of the present invention.
Figure 2:
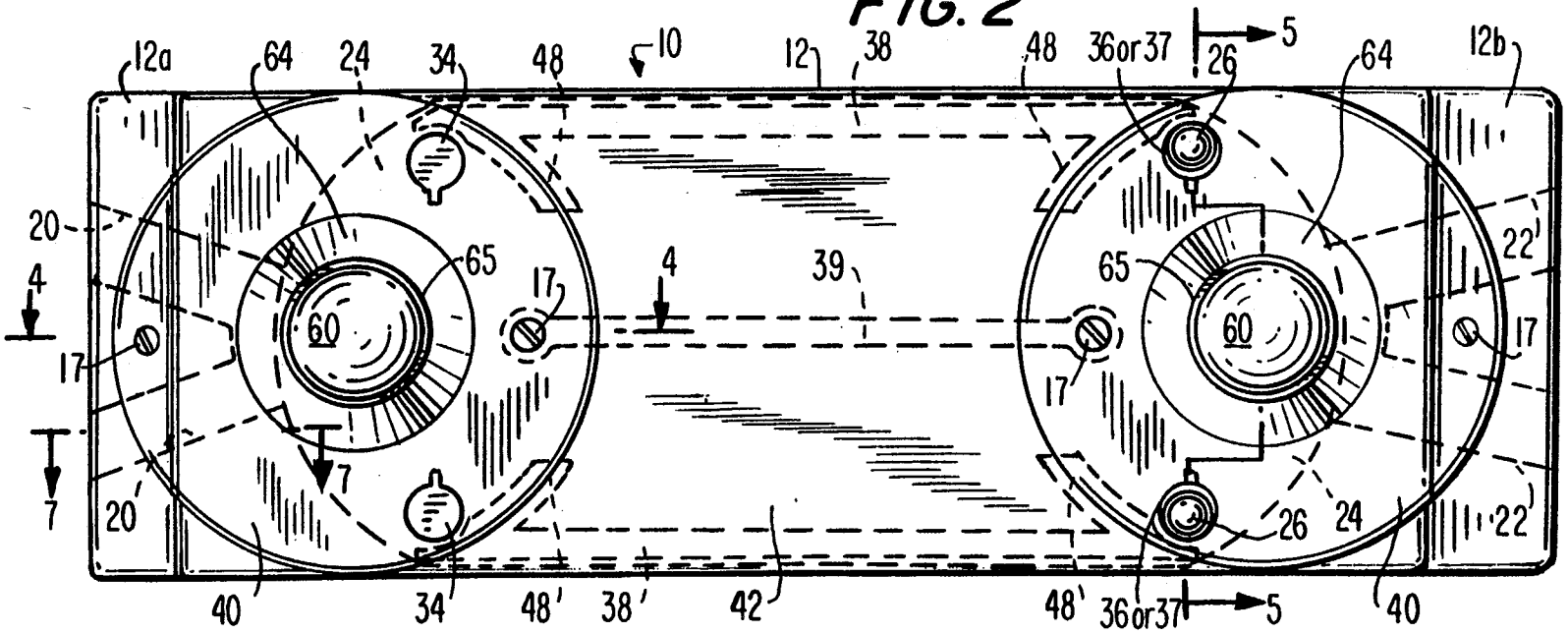
FIG. 2 is a bottom view of FIG. 1.
Figures 3, 4, 5, 6, 7, 8:
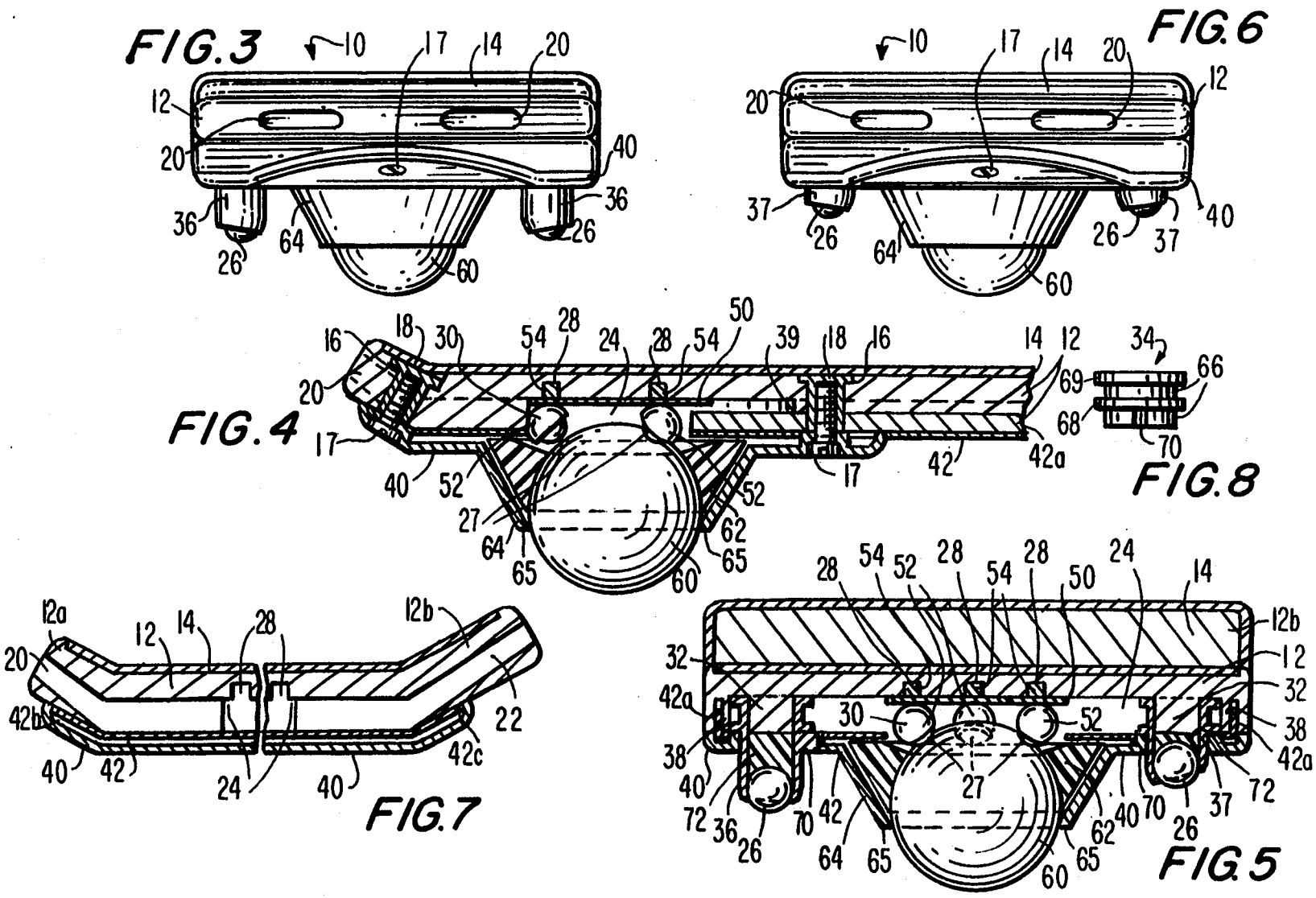
FIG. 3 is a front view taken along line 3—3 of FIG. 1.
FIG. 4 is a partial vertical-sectional view taken along line 4—4 of FIG. 2, of a front-end of the skateboard of FIG. 1 with certain parts not shown for clarity.
FIG. 5 is a sectional view taken along line 5—5 of FIG. 2.
FIG. 6 is a front view of a second embodiment of the present invention.
FIG. 7 is a partial vertical-sectional view taken along line 7—7 of FIG. 2, showing the front and back ends of the body.
FIG. 8 is a front view of a side plug according to the present invention.

The skateboard of the invention, generally designated 10 in FIGS. 1 and 2, comprises a long rectangular body 12, with rounded comers, which is cast in plastic or other sturdy flexible material. The front **12*a* and back 12*b* of body 12 are angled upward allowing greater control and better footing. The top of body 12 is recessed and rough to accommodate a mat 14. Four holes 16 extend through the depth of the body (two are shown in FIG. 4) and are centered from the sides of the body. Four female securing bolts 18 are tightly fit in holes 16. Two air passages 20 and 22 at the front and the back of the body respectively, angle toward the center of the body 12 (FIG. 7) and connect to a respective pair of large cavities 24 in the middle of the body. These airways cool ball bearings 27 in the cavities (see FIGS. 4 and 5). Three hollows 28 at the front and three at the back of the cavity secure each ball bearing holder 30 for sockets 52 and bearings 27. The hole of each holder that is closest to the respective end of the body is centered from the sides of the body. Four round islands 32 located at the comers of each cavity 24 serve as mounts and protrude to the same level as the bottom of the body. Side plugs 34 (FIGS. 2 and 8) and side guides 36, 37 (FIGS. 5 and 6) fit over islands 32 and are selectively exchangeable in identical pairs at the back cover plate, depending on the rider's skill in riding the skateboard 10. While different sizes of side guides 36, 37 are shown in FIG. 5 to differentiate the variation in size contemplated by the invention, a single size is selected when in use. Long side guides allow the most limited lateral pitch and the most easily applied steering traction. Short side guides allow more lateral pitch requiring greater control by the rider to apply steering traction. Side plugs do not limit lateral pitch and provide no steering traction, a mode requiting an expert rider. The caps and square tags of plugs 34 are flush with bottom of cover plate 40 and are always installed in the front cover plate. Side plug 34 and round islands 32 are not shown in FIG. 4** for the purpose of clarity of the other parts.

Three long, thin islands 38 and 39 protruding to the same level as the bottom of the body and support the circular cover plates 40 and glide plate 42 and strengthen the body as shown in FIG. 2 and 5. These three thin islands 38, 39 run parallel to each other from the front 12*a* to the back. 12*b* of the body 12. The center island 39 connects and surrounds the two inner holes 16 that hold the female securing bolts 18. Each side island 38 is located close to each side of the cavity 24, forming a narrow groove on each side of the body 12. Two side flanges 42*a* of the glide plate 42 fit into these grooves, covering its metal edges and loosely securing its sides to the body without inhibiting torque of the body. Each end of both side islands 38 has a barb-like projection 48 (FIG. 2) on which the edge of each circular cover plate 40 rests.

The rough, non-skid surface mat 14 allows traction and sure-footed control of the skateboard 10 by the rider. Adhesive backing attaches the mat 14 to the recessed top of the body 12 and the closed tops of the four female securing bolts 18. The tops of the fiat headed bolts 18 are rough to enable adherence to the mat 14. The hollow cylinder of bolts 18 is equipped with a large spiral groove on its inner surface into which a male bolt 17 securely fits. These bolts hold all parts of the skateboard 10 together. They are made of steel and the threading is thick and is coiled as tightly as possible for maximum holding power. Each female bolt 18 is countersunk into the plastic body 12, making the tops of the heads flush with the top of the body 12. The bolt 18 runs to a point just short of the bottom surface of the body 12, and upon tightening, to the inside surface of the circular cover plate 40 as shown in FIG. 4.

The male securing bolts 17 have a flat, slotted head, and are made of durable steel and each have a large spiral groove. The grooved solid cylinder is untapered and shorter than each female securing bolt 18 into which it is fastened. Holding power is enhanced by the tension created by the additional thickness of the plastic body when tightened. The resistance of the plastic, when compressed by the tightening of the shorter bolts 17, keeps the connection from loosening. The male securing bolt 17 connects to the female securing bolt 18 through the countersunk holes in the circular cover plate 40.

Glide plate 42 is thin chrome metal and protects the cavity and inner parts of the skateboard and provides a slick under-surface for bottom-side sliding. The sides are bent upward at a 90° angle creating the short wide (and flat) flanges 42*a*. The from 42*b* and back 42*c* are trimmed half circles that are a bit smaller than the size of the circular cover plate 40. The circular cover plates 40 cover the circular sharp edges of the glide plate 42 upon assembly as best shown in FIG. 7. There are ten holes in the glide plate 42 that accommodate various parts of the skateboard. The four holes centered from the side permit open space for the female securing bolts 18 to connect to the male securing bolts 17, stably anchoring the circular cover plate 40 to the body 12. The four holes closest to the sides allow open space for the side plugs 34 and side guides 36 or 37. The two large holes at each end provide open space for the ball bearing holder sockets 52, ball bearings 27 and roller balls 60. The glide plate 42 has openings for accommodating sockets 52, bearings 27, roller balls 60, bolts 18, plugs 34 and guides 36 or 37 and is sandwiched between the body 12 and its islands 38, 39 and the circular cover plates 40.

Each ball bearing holder 30, comprises a flat ring 50, three sockets 52 and three posts 54. The ring 50 has the same circumference as the roller ball 60 to be described later. Three holes in the flat ring, equidistant from each other, anchor the sockets 52 and posts 54 in place. The connections are soldered. The socket 52 and post 54 are cast as one piece. The post is connected perpendicularly to the ring 50, protruding through the top, fixing the socket 52 in place below the ring 50. Each socket 52 is a half-sphere with an interior surface plated with hard, slick and abrasion resistant metal. When mounted to the ring 50, the socket 52 opening plane is perpendicular to a line from the center of the roller ball 60 (upon assembly) to the center of the socket 52. The three posts 54 of each ball bearing holder 30 fit into the hollows 28 of the body 12. The ring 50 is seated within each cavity 24 of the body 12. Each socket 52 loosely holds one ball bearing 27. The ball bearing holders 30 are made of aluminum alloy for dispersion of heat produced by the friction of the ball bearings 27. The holder 30 is strong enough to support the weight of the skateboard 10 and rider.

Ball bearings 27 are made of steel and roll freely in the sockets 52 of the ball bearing holders 30 allowing reduced friction and unlimited direction in the movement of the roller balls 60.

Roller balls 60 are large lightweight balls which support and give motion to the skateboard 10. They are either hollow steel cast metal or steel plated lightweight metal balls. The metal exterior is extremely hard, resisting pitting, denting and other abrasions of skateboarding surfaces. The roller balls 60 replace the wheels of a conventional skateboard, allowing the maximum enhanced directional movement of 360°. The roller balls are sandwiched between the ball bearings 27 and the circular cover plate 40. Conical cleaners 62 snugly fit in cover plates 40 and form fit balls 60.

The ball cleaners 62 are inside the conical extension 64 of the circular cover plate 40, pressing against and form fitting to the interior of the conical extension and the roller ball 60. The top of each cleaner tightly rests against the glide plate 42, tapered downward from the glide plate opening to prevent contact with and possible jamming of the ball bearings 27. The bottom of the cleaners 62 is thick enough and distanced far enough away from the bottom rim of the circular cover plate 40, to prevent jamming of the roller ball 60 by the cleaner 62 from below. In the sequence of assembly, the roller ball cleaner 62 is installed between the glide plate 42 and the roller ball 60. The entire form of the roller ball cleaner 62 is made of synthetic "steel wool" (for example, the known green scrub pads used for scouring pots and pans).

The side plug 34 as shown in FIG. 8, is one piece and cast in metal. The hollow part of the cylinder 66 of each plug 34 fits over the round island 32 of the body 12. The solid part of the cylinder 66 fills the space between the top of the island 32 and the outer surface of the circular cover plate 40. The hollow and solid parts of the cylinder 66 form the cap of the side plug 34. Two fixed washers 68, 69 on parallel planes to the surface of the body encircle the outside of the cylinder 66. The top of one washer 69 is flush with the top of the plug 34 and upon assembly, rests against the upper surface of the body cavity 24. The bottom of the lower washer 68 rests against the interior surface of the circular cover plate 40. A square tag of metal 70 protrudes from the bottom of the lower washer 68 to the level that is flush with the outer surface of the circular cover plate 40 upon assembly. The side plugs 34 fill the openings in the circular cover plates 40 that are not filled by side guides 36, 37 (see FIG. 2). The plugs 34 and guides 36, 37 are interchangeable. Normally, two plugs 34 are installed in the front circular cover plate 40 and two guides 36 or 37 in the back plate 40. The plugs 34 are a stable connection from the body 12 to the circular cover plate 40. Upon assembly, the plugs 34 are flush with the outside surface of the circular cover plates 40, leaving no open space.

Aluminum side guide spacers 72 are part of the side guides 36 and 37. They are each a solid cylinder with a flat top and a concave bottom. The bottom is plated with hard and abrasion resistant metal. Upon assembly, the spacers 72 hold the side guide ball bearings 26 in place, filling the area between the body island 32 and ball bearing 26 in the hollow interior of the side guide cylinder. The tightness of fit allows limited movement of the ball bearing 26, providing traction for steering of the skateboard 10. There are two lengths of side guide spacers 72 as there are two different sizes 36 and 37 of side guides. Only same size side guides are used together.

Side guide ball bearings 26 are steel ball components of the side guides 36, 37. They are securely held in place inside the side guide cylinder of each guide 36 or 37 by the concave end of the spacer 72 from above and the narrowed bottom opening of the cylinder 36 or 37 from below. The bottom opening of the cylinder of 36 or 37 allows the ball bearing 26 to protrude beyond its opening. The interior sides of the cylinder 36 or 37 contact the ball bearing 26.

The side guide cylinders 36 or 37 are hollow, one piece and cast in metal. Two fixed washers and a square tag are identical in specification and assembly as those of the side plugs 34. In contrast to the side plug 34, the cylinder 36 or 37 has no cap. The cylinders 36, 37 pass through and extend beyond the openings in the back circular cover plate 40. There are two different lengths of cylinders for the different length guides 36 and 37. Only the same lengths are used at the same time. The hollowness of the shaft from the top opening to just before the bottom opening is straight and barrel-like. The circumference of the bottom opening is smaller than that of the barrel of the cylinder. The mouth is formed to hold the ball bearing 26 in the same fashion as the shaft of a ball point pen holds the ball of the pen. The narrowing is concentric to the ball bearing 26 upon assembly. The ball bearing 26 extends beyond the mouth like the ball point pen. However, the mouth is angled in order to be parallel with the ground upon tilting the skateboard 10 as shown in FIGS. 3 and 6, to the point of contact of the ball bearing 26 with the ground. The two different lengths of cylinders 36 or 37 require two different angles. The circumference of the interior side of the cylinder 36 or 37 is larger than those of the ball bearing 26 and spacer 72 only to a degree that allows the assembly of the side guide. Each ball bearing 26 protrudes through the bottom opening and rests against the concentric narrowing of the cylinder 36 or 37. The top of the ball bearing 26 rests against the concave surface of the side guide spacer 72 (see FIG. 5, for example). Upon assembly, the body island 32 rests against the flat top of the spacer 72. This lateral stack is tight, allowing very limited movement. The three assembled components of cylinder 36 or 37, spacer 72 and ball bearing 26 provide directional control of the skateboard 10. This is achieved by the rider tilting the skateboard 10 to the left or to the right, contacting the ground with a ball bearing 26 of a side guide 36 or 37. This contact provides a drag force like that of a brake; and the braking allows directional control. For the beginning rider, the longer side guides 36 provide the best brake control but hinder free lateral tilting and ground clearance of the skateboard 10. The shorter side guide 37 allows the intermediately skilled rider more freedom of lateral movement and increased ground clearance. The shorter length requires a greater degree of tilt on the skateboard 10 for the side guide ball bearing 26 to contact the ground. The rider has more freedom to control direction by shifting body weight. The advanced rider can eliminate all side guide brake control and hindered lateral and ground clearance by replacing the side guides 36 or 37 with side plugs 34 and using the angled end of the back circular cover plate for brake control. Directional control is solely achieved by the shifting body weight of the rider; and direction is unlimited.

The circular cover plates 40 are durable metal plates cast of one-piece construction. The outside of each is curved upwards at a 90° angle allowing the width edge of the plate 40 full contact with the body 12 and lowering the flat plate surface from the body 12 upon assembly as shown in FIG. 5. The front of the front plate (back of the back plate) is inclined to the same specifications as the front **12*a* and 12*b* of the body 12 as shown in FIG. 7. A round hole with a square notch that juts out toward the center of the plate is located on each side of the flat surface. Upon assembly, these holes are located under the round islands 32 of the body 12 and securely hold the side plugs 34 and side guides 36 or 37. A countersunk hole is centered at connection to each female securing bolt 18. Upon assembly, the top of the male securing bolt is flush with the exterior flat surface of the circular cover plate 40 as shown in FIG. 4. A conical extension 64 concentric to the circular cover plate 40 projects below the flat surface. The slope of the angle and interior diameters of the cone 64 allow the roller ball 60 unincumbered movement within the cone 64. The mouth of the cone 64 is smaller than the diameter of the roller ball 60, so that the ball 60 cannot be ejected. The edge of the mouth at 65 is the only rough edge of exposed metal upon assembly. Its diameter allows clearance enough for the free movement of the roller ball 60, but the closeness of diameters prevents debris from being carried into the interior areas of the skateboard 10 by the roller ball 60. This debris is scraped off of the roller ball 60 by the edge 65 of the mouth of the cone 64. The inclined area 12*b* or heel of the back circular cover plate 40 serves as a brake by tilting the skateboard 10 backwardly to the point of contact with the ground. The back and front circular cover plates 40 are identical and therefore interchangeable. The circular cover plates 40 hold together the components of the skateboard 10 from below as the body 12 does from above. The bottom exterior surface of the cover plate 40 allows bottom-side sliding while protecting components of the skateboard 10** from damage.

While specific embodiments of the invention have been shown and described in detail to illustrate the application of the principles of the invention, it will be understood that the invention may be embodied otherwise without departing from such principles.

What is claimed is:

1. A skateboard comprising:

a body having two cavities formed therein at a bottom of the body;

ball bearing means rotatably mounted in each cavity;

a roller ball rotatably mounted within each cavity and partially extending from the bottom of the body, the roller ball being in contact with the ball bearing means for providing 360° rotation of the roller ball and for rolling the body along a surface;

a plurality of mounts fixed within each cavity and positioned laterally adjacent each roller ball;

a glide plate having openings therethrough and fixed to the bottom of the body over the cavities for providing a sliding surface and protecting the skateboard, the openings in the glide plate allowing the ball bearing means, the roller balls and the mounts to extend therethrough;

a cover plate having a ball aperture and a plurality of mount apertures therethrough and fixed to the bottom of the body over the glide plate at each cavity, the ball aperture in the cover plate allowing the roller ball to extend therethrough and the mount apertures in the cover plate aligned over each mount; and side traction and lateral pitch inhibitor means detachably connected to the mounts through the mount apertures of the cover plates for steering and controlling lateral pitch of the body.

2. The skateboard according to claim 1, wherein the side traction and lateral pitch inhibitor means comprises a side guide detachably connected to the mount through the mount apertures of the cover plate, the side guide comprising a cylinder detachably connectable to the mount at one end of the cylinder and at an opposite end of the cylinder having a ball bearing rotatably mounted therein and partially extending through the opposite end of the cylinder, the side guide for extending through the cover plate and outwardly from the bottom of the body for contacting the surface at the ball bearing.

3. The skateboard according to claim 2, wherein the side guide is mounted at an angle outwardly from the mount.

4. The skateboard according to claim 3, including a plurality of side guides having different lengths.

5. The skateboard according to claim 4, wherein the side guide is mounted to the mount at a specific angle corresponding to a specific length.

6. The skateboard of claim 2 whereby the ball bearing in the side guide is tightly held in place by a spacer between the wall and the ball bearing.

7. The skateboard according to claim 2, wherein the lateral pitch selection means further comprises a plug detachably connected to the mount through the mount aperture such that the plug fits directly over the mount and covers the mount aperture of the cover plate.

8. The skateboard according to claim 1, wherein the ball bearing means comprises a plurality of ball bearings rotatably mounted within the cavity such that the ball bearings contact the roller ball and rotate with the rotation of the roller ball.

9. The skateboard according to claim 1, wherein the body has an air passage therein and extending from a front end and a back end of the body to the cavity for cooling the ball bearings.

10. The skateboard according to claim 1, wherein the cover plate further comprises a conical extension having an opening for permitting the roller ball to extend through the opening.

11. The skateboard according to claim 10, wherein cleaning means are provided within the conical extension adjacent to and in contact with the roller ball for scraping debris from the roller ball.

12. The skateboard according to claim 11, wherein the cleaning means comprises a synthetic wooly material.

13. The skateboard according to claim 1, wherein the front end and the back end of the body are upwardly sloped.

14. The skateboard according to claim 1, wherein a plurality of elongated islands are fixed to the bottom of the body and horizontally extend between the cavities for supporting the guide plate and the cover plates.

15. The skateboard according to claim 1, wherein the body is made of a flexible material.

16. The skateboard according to claim 15, wherein the body is made of plastic.

17. The skateboard according to claim 1, wherein the cover plates are circular.

18. The skateboard according to claim 13, wherein a mat is fixed to an upper surface of the body for providing footing.

* * * * *